US010985497B1

(12) United States Patent
Peng et al.

(10) Patent No.: US 10,985,497 B1
(45) Date of Patent: Apr. 20, 2021

(54) CONNECTING DEVICE WITH MULTIPLE AXIAL CONNECTORS

(71) Applicant: F TIME TECHNOLOGY INDUSTRIAL CO., LTD., New Taipei (TW)

(72) Inventors: Chang-Lin Peng, New Taipei (TW); Xin-Fu Liu, New Taipei (TW)

(73) Assignee: F TIME TECHNOLOGY INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 16/705,777

(22) Filed: Dec. 6, 2019

(51) Int. Cl.
*H01R 13/58* (2006.01)
*H01R 4/48* (2006.01)

(52) U.S. Cl.
CPC ..... *H01R 13/5825* (2013.01); *H01R 4/48* (2013.01)

(58) Field of Classification Search
CPC ..... H01R 13/5825; H01R 4/48
USPC ..... 439/638
See application file for complete search history.

(56) References Cited

U.S. PATENT DOCUMENTS 3,129,993 A * 4/1964 Ross ..... H01R 13/64 439/294
5,224,187 A * 6/1993 Davisdon ..... G02B 6/3887 385/100
5,632,653 A * 5/1997 Sawada ..... H01R 13/5208 439/279
5,993,266 A * 11/1999 Mayer ..... H01R 13/5213 439/294
6,716,063 B1 * 4/2004 Bryant ..... H01R 13/5208 439/589
7,273,395 B2 * 9/2007 Hayashi ..... H01R 13/506 439/587
7,726,997 B2 * 6/2010 Kennedy ..... H01R 13/521 439/274
9,106,066 B2 * 8/2015 Sakakura ..... H02G 15/013
9,219,329 B2 * 12/2015 Murphy ..... H01R 13/582
9,583,864 B1 * 2/2017 Vo ..... H01R 13/02
9,755,350 B2 * 9/2017 Yamada ..... H01R 13/4367
9,774,138 B1 * 9/2017 Peng ..... H01R 13/506
10,141,684 B2 * 11/2018 Itzler ..... H01R 13/5205
10,355,400 B2 * 7/2019 Yokoyama ..... H01R 13/502
10,389,061 B2 * 8/2019 McDowell ..... H01R 13/5208
10,483,676 B2 * 11/2019 Peng ..... H01R 13/4361
10,720,728 B2 * 7/2020 Mears ..... H01R 13/5208

* cited by examiner

*Primary Examiner* — Abdullah A Riyami
*Assistant Examiner* — Vladimir Imas
(74) *Attorney, Agent, or Firm* — Guice Patents PLLC

(57) ABSTRACT

A connecting device with multiple axial connectors. The connecting device includes a main base and a plurality of connectors, wherein the main base has a long shape. A plurality of first through holes are formed on the main base, and the connectors extend through the first through holes. Each connector has a tubular body, and a groove is formed on an outer periphery of the tubular body. A wire extends from one end of the tubular body. A c-shaped clamp joins the groove and presses an inner surface of the first through hole, whereby the connectors is secured to the main base. The difficulty of maintenance of the connecting device is reduced.

8 Claims, 8 Drawing Sheets

CONNECTING DEVICE WITH MULTIPLE AXIAL CONNECTORS

BACKGROUND OF THE INVENTION

Field of the Invention

The invention relates to a connector, and more particularly to a connecting device with multiple axial connectors.

Description of the Related Art

With the booming electronics industry, various electronic products continue to pursue better transmission quality and immediacy, and provide multi-oriented product applications. These application demands will force the signal transmission speed and performance to continue a high speed development. The design of the connecting device is to meet such requirements.

In order to meet the transmission requirements of multiple signals, a plurality of connectors are simultaneously assembled to a base, thereby providing the transmission requirement of the multiple axial connector. In the prior art, in order to fix the plurality of connectors to the base, using the riveting design, a plurality of connectors are simultaneously pressed into the perforations formed on the base through the pressing jig, so that the connectors are fixed on the base.

Although the connectors are assembled on the base by the design of the riveting, the method is pressure-assembled, and does not take the disassembly condition into account. Once a single connector is damaged, the whole set of the multiple axial connectors of such a structural design must be replaced, and it is impossible to replace only the damaged connector, which causes an increase in the cost of maintenance, and has become a problem that the skilled person wants to solve.

BRIEF SUMMARY OF THE INVENTION

In view of the above-mentioned shortcomings, the main purpose of the present invention is to provide a connecting device with multiple axial connectors, which performs a simple replacement of to a damaged single connector through a detachable structure design, thereby reducing the cost and difficulty of maintenance. The assembly aspect of the connector is increased.

To achieve the aforementioned object, the present invention provides a connecting device with multiple axial connectors. The connecting device includes a main base and a plurality of connectors, wherein the main base has a long shape. A plurality of first through holes are formed on the main base, and the connectors extend through the first through holes. Each connector has a tubular body, and a groove is formed on an outer periphery of the tubular body. A wire extends from one end of the tubular body. A c-shaped clamp joins the groove and presses an inner surface of the first through hole, whereby the connectors is secured to the main base.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
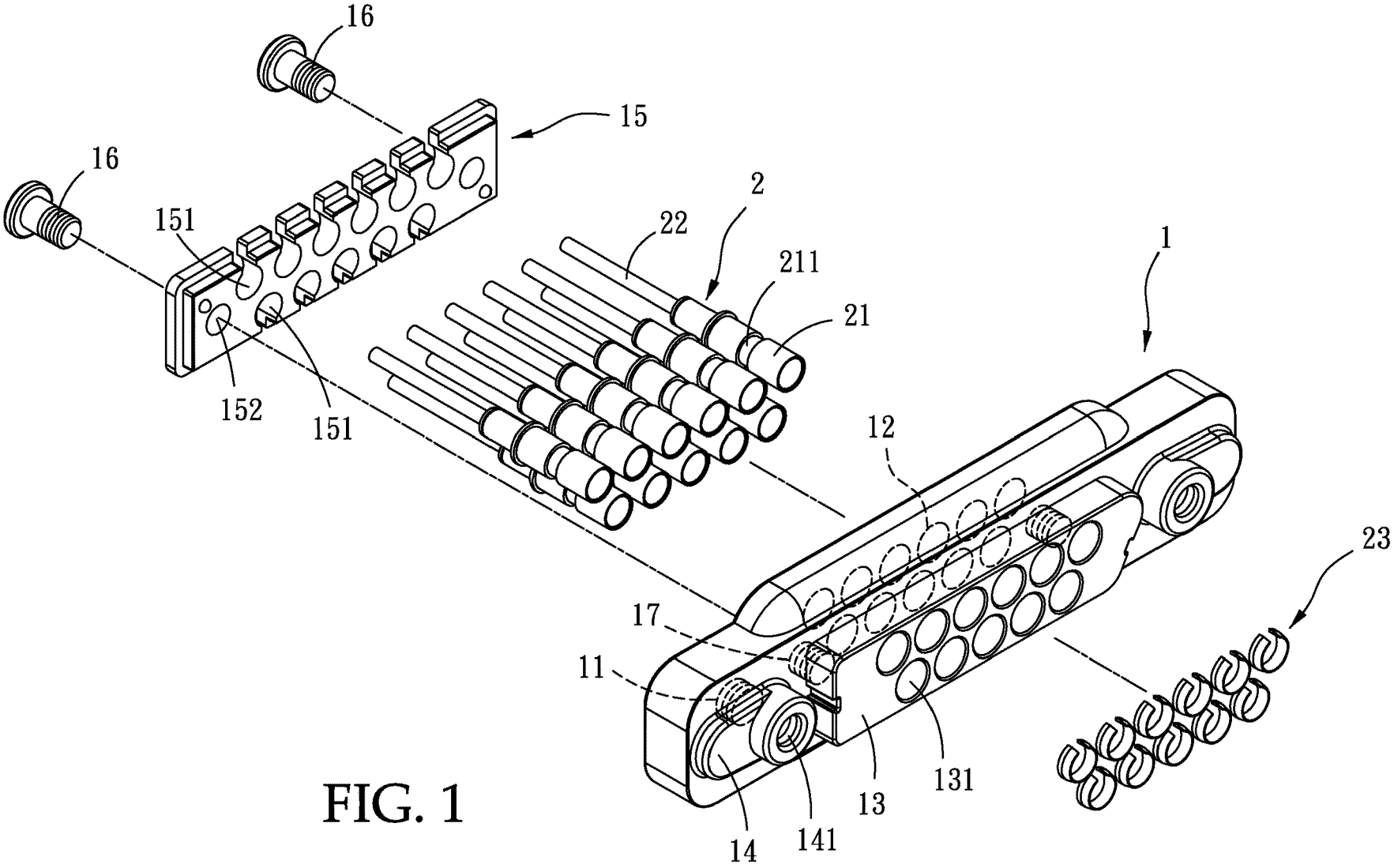
FIG. 1 is a exploded perspective view of an embodiment of a connecting device of the present invention.
Figure 2:
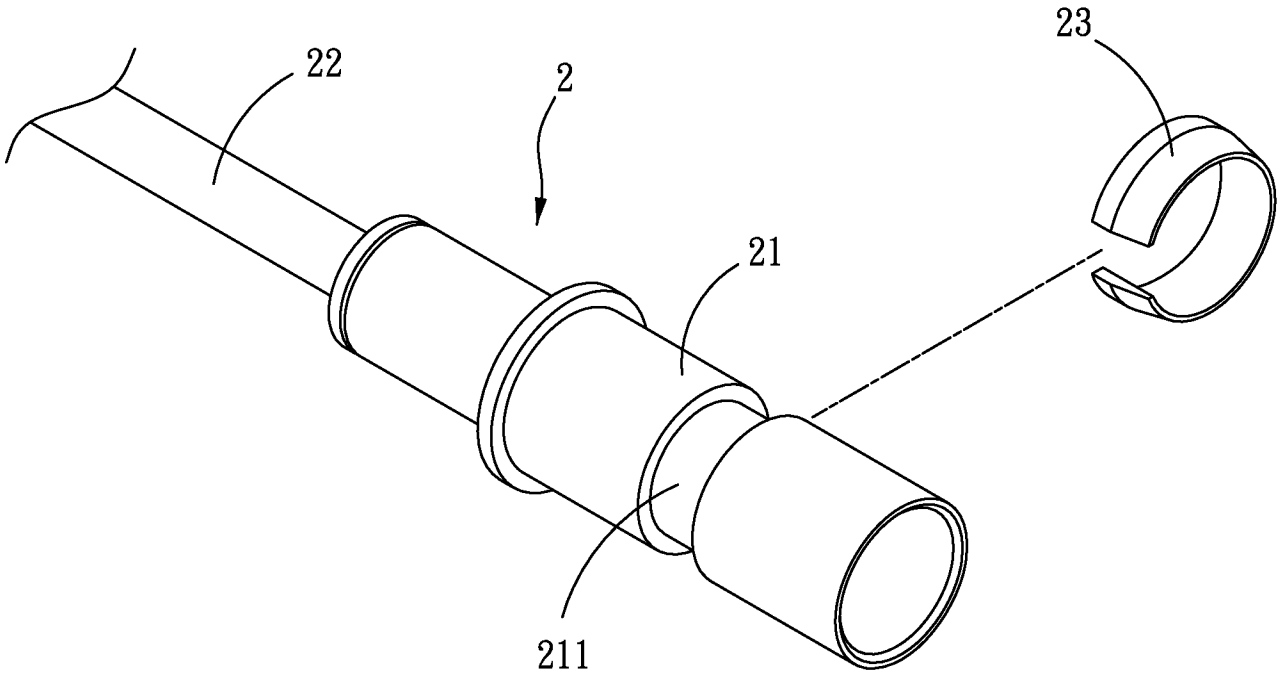
FIG. 2 is an enlarged view of an embodiment of a connecting device of the present invention.

Please refer to FIG. 1, which is an exploded perspective view of the connecting device of the present invention. As shown in the figure, the connecting device of the present invention mainly comprises a main base 1 which is a long-shaped seat body, and has two circular holes 11 formed near two sides of one end surface of the main base 1, respectively. The main base 1 has a plurality of first through holes 12, and has a protruding plate 13 on the other end surface of the main base 1. The protruding plate 13 is correspondingly assembled with the plurality of first through holes 12, and a plurality of second through holes 131 are defined on the protruding plate 13. Each of the second through holes 131 corresponds to a position of one of the first through holes 12, so that the second through hole 131 is in communication with the corresponding first through hole 12. The main base 1 has two protruding seats 14 located on the same end surface and on two opposite sides of the protruding plate 13. Each protruding seat 14 has a concave hole 141 therein.

Figure 4:
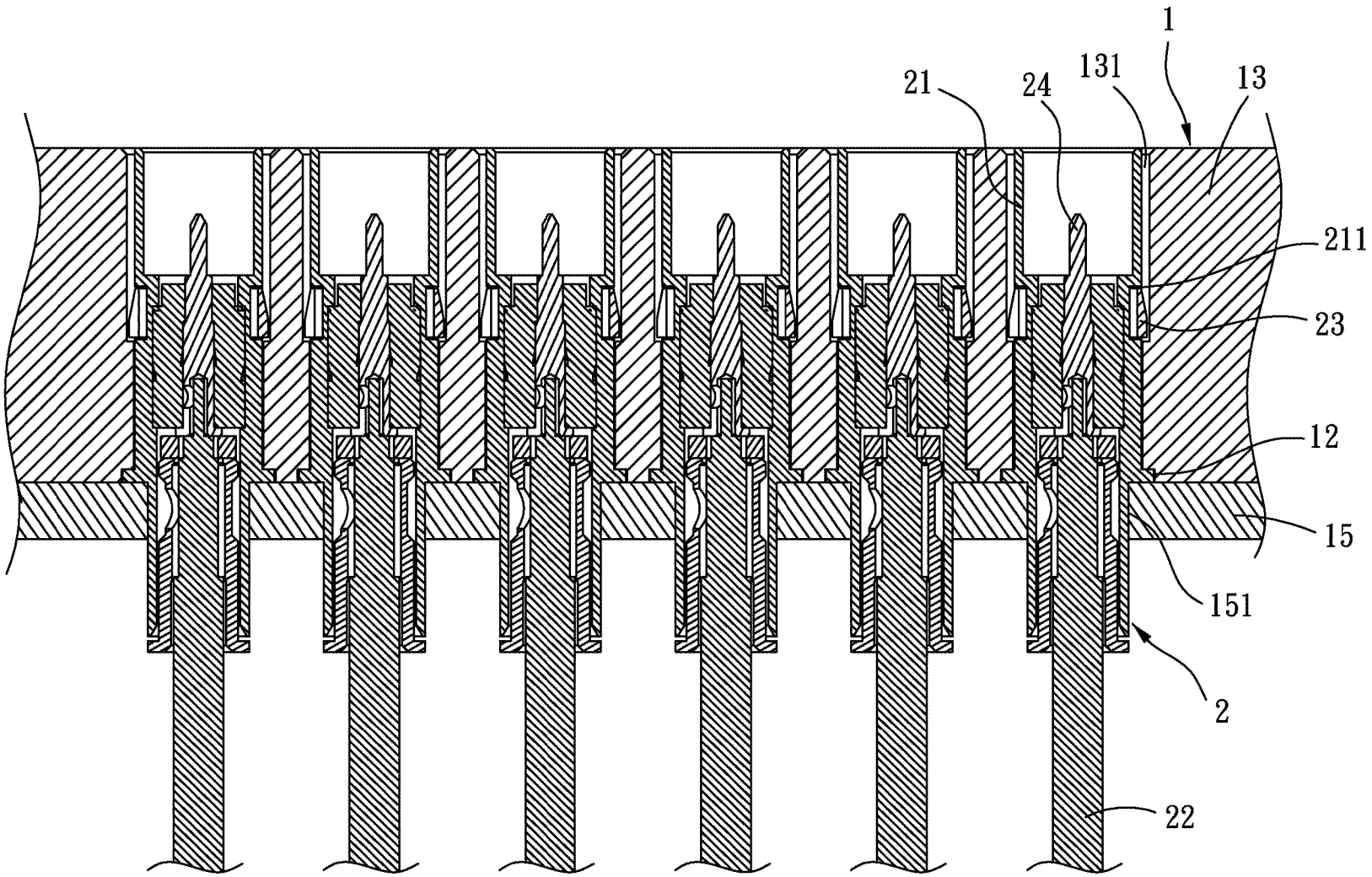
FIG. 4 is a cross section of an embodiment of a connecting device of the present invention.

Referring FIG. 1 again, the other end surface of the main base 1 is connected to a fixing plate 15 to close the other end surface of the main base 1. The fixing plate 15 has a plurality of openings 151. In the embodiment, the openings 151 are C-shaped, and the notches of the openings 151 exactly correspond to the two opposite long sides of the fixing plate 15, and the openings 151 respectively correspond to the first through holes 12 of the main base 1. A latching hole 152 is defined near each of the two ends of the fixing plate 15, and each latching hole 152 is correspondingly latched with a latching member 16. In the embodiment, the latching member 16 is a fixing bolt, and the latching member 16 is T-shaped. The main base 1 has a plurality of fixing holes 17 exactly corresponding to the latching holes 152 for latching the corresponding latching member 16, whereby the position of the fixing plate 15 relative to the main seat body 1 is fixed, as shown in the cross section of the assembled structure of FIG. 4.

Figure 3:
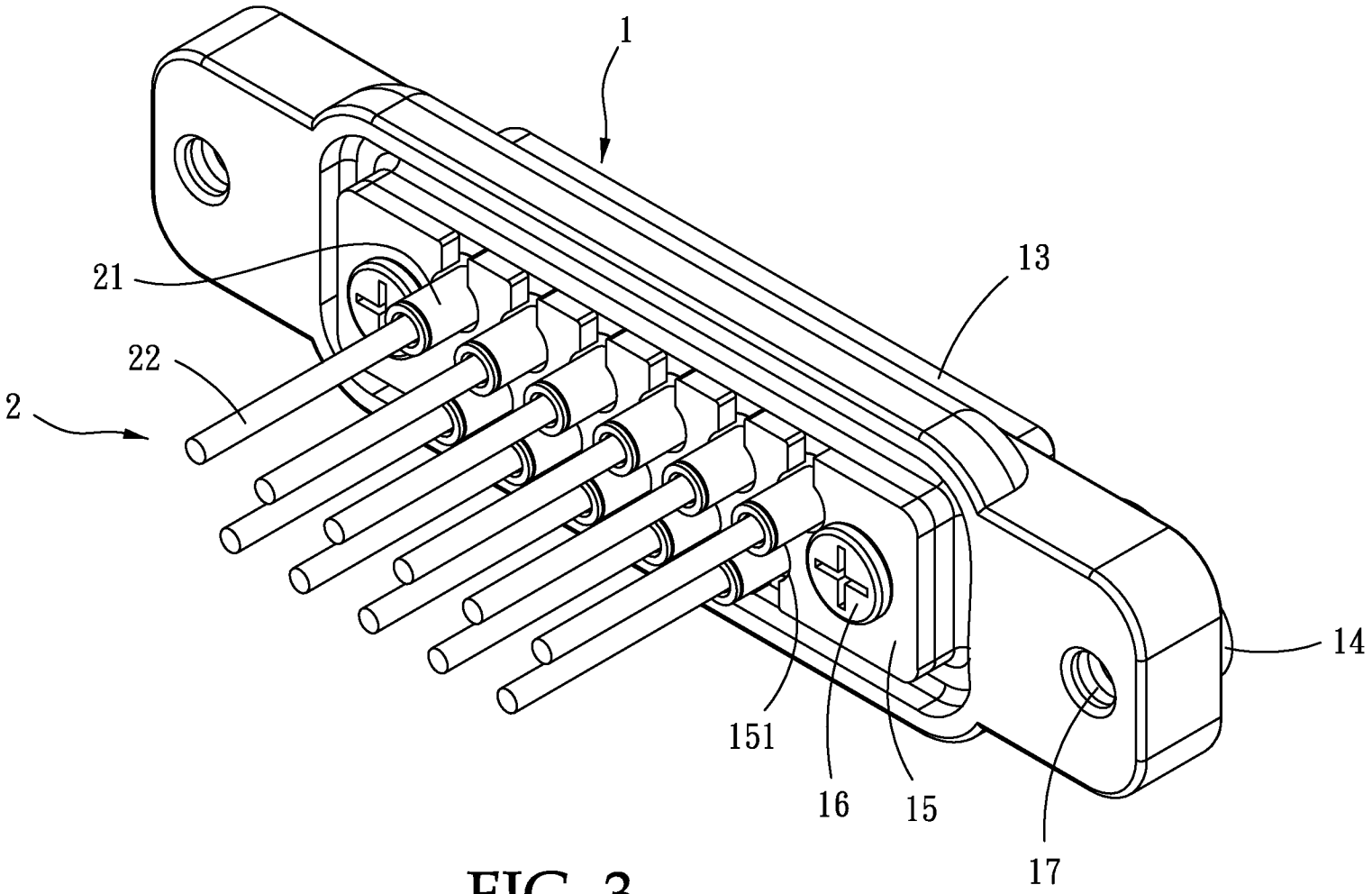
FIG. 3 is an assembly view of an embodiment of a connecting device of the present invention.

Referring to FIG. 1, the connecting device of the present invention further includes a plurality of connectors 2, which are respectively disposed in the respective first through holes 12 of the main base 1. In the embodiment, the connectors 2 are female connectors. Referring to the enlarged view of the three-dimensional structure of the connector of the second embodiment, each of the connectors 2 has a tubular body 21, and a groove 211 is formed on the outer surface of the tubular body 21, and a wire 22 extends outwardly at one end of the tubular body 21. A C-shaped clamp 23 is joined to the groove 211, and a conductive rod 24 in disposed in the tubular body 21. As shown in the cross-sectional view of the assembled structure of FIG. 4, the conductive rod 24 and the wire 22 are electrically connected. The connectors 2 are urged through the C-shaped clamp 23 to press the inner wall surface of the first through hole 12 so that the connectors 2 are fixed in the main base 1. The assembled view is as shown in FIG. 3.

Figure 5:
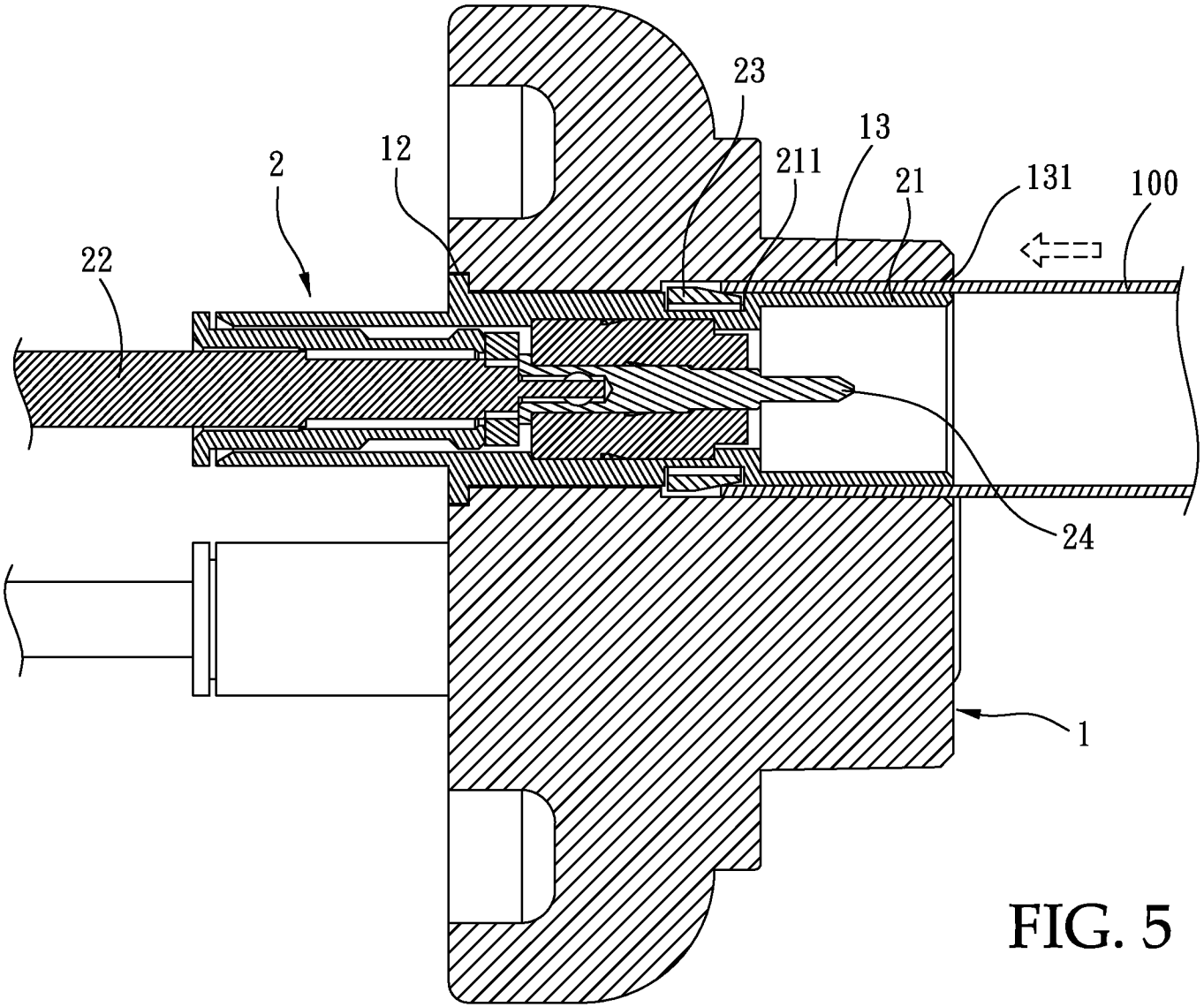
FIG. 5 depicts an operation (I) of an embodiment of a connecting device of the present invention.
Figure 6:
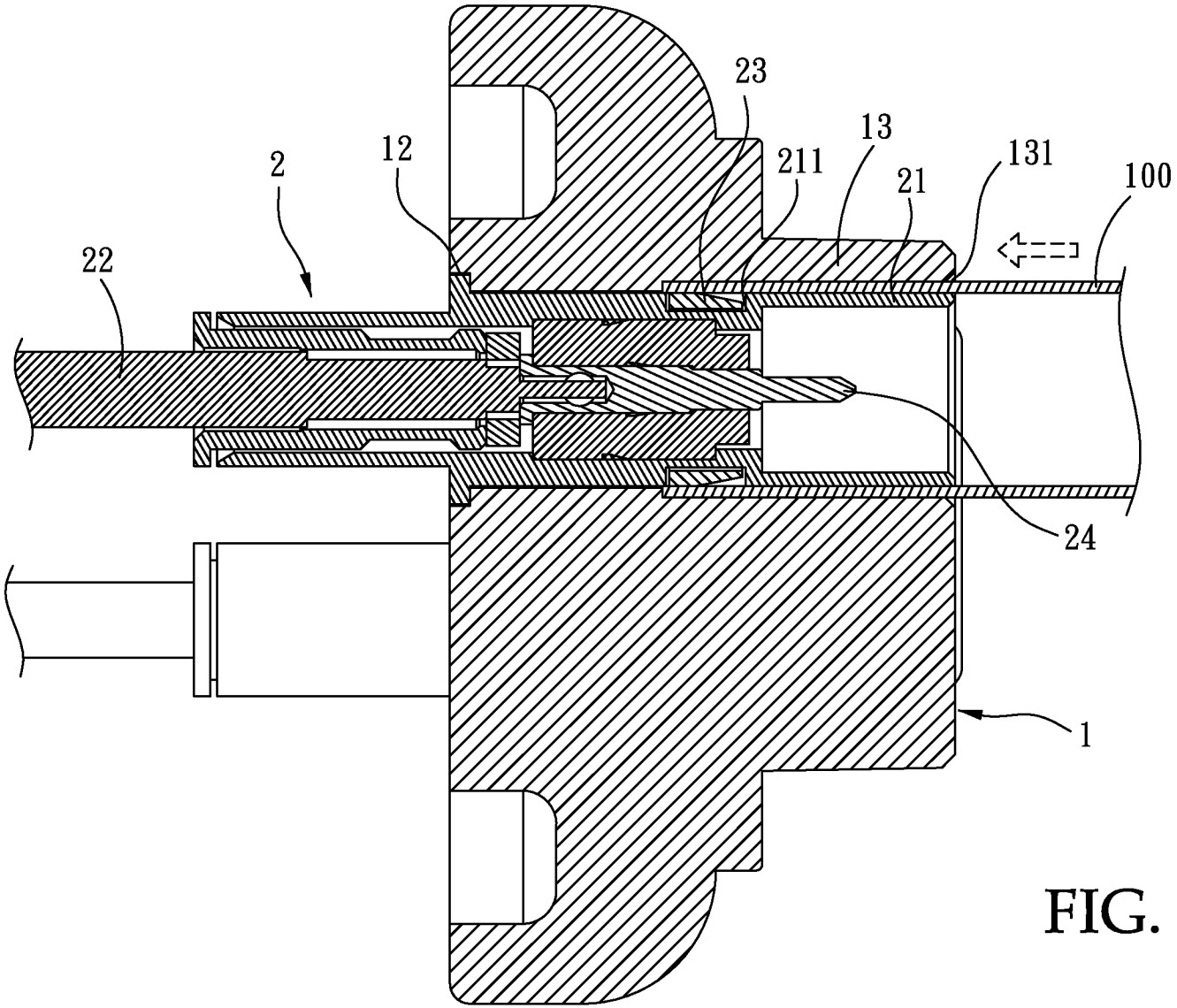
FIG. 6 depicts an operation (II) of an embodiment of a connecting device of the present invention.
Figure 7:
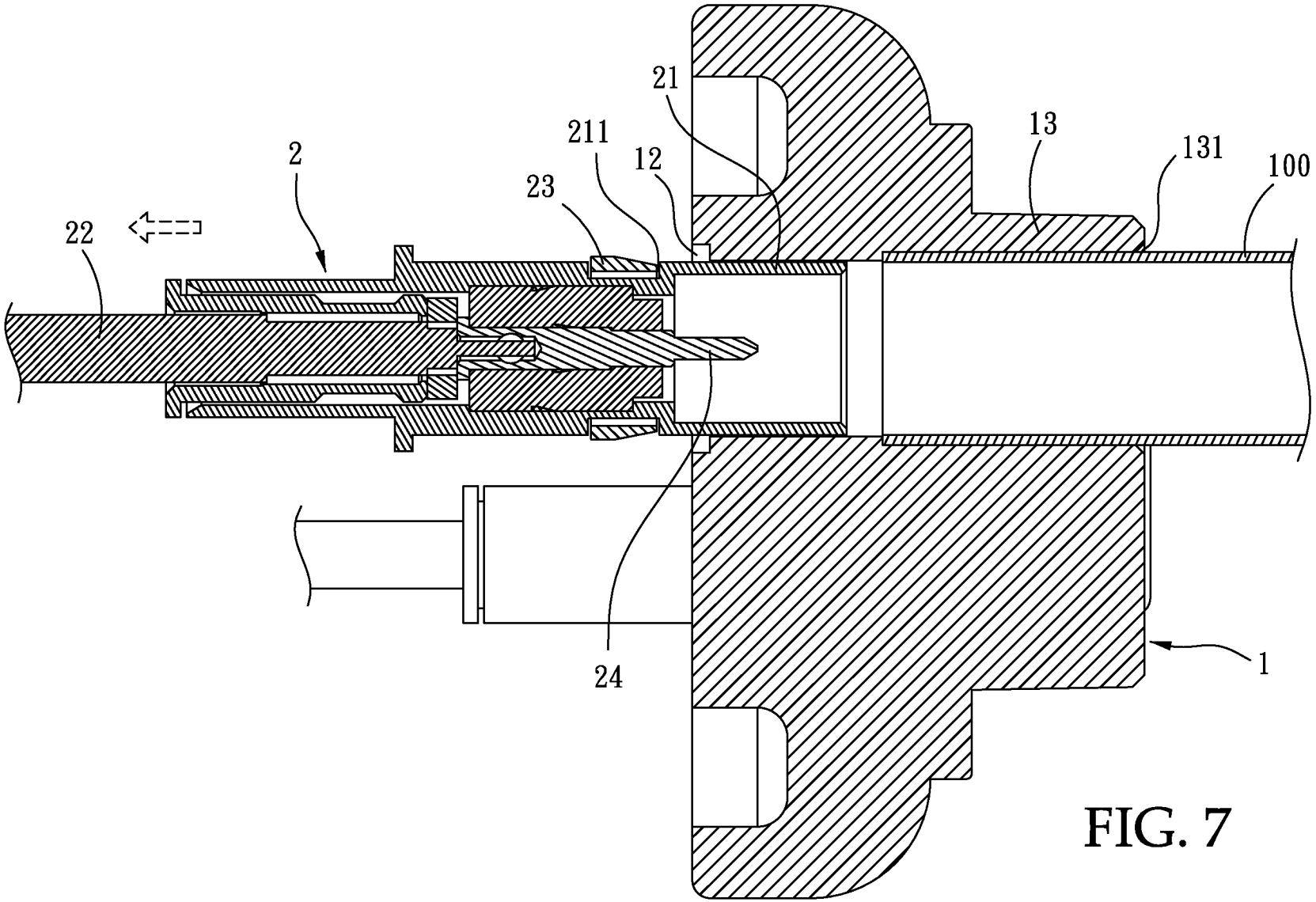
FIG. 7 depicts an operation (III) of an embodiment of a connecting device of the present invention.

Referring to FIGS. 5 to 7, which are the continuous operation of the connecting device of the present invention. As shown in FIG. 5, in the connecting device of the present invention, the connectors 2 are combined and fixed in the main base 1 via the C-shaped clamp 23 to provide a multi-wire connection. If a single connector 2 fails, the failed connector 2 is inserted through the end of the main body 1 through a jig 100, and the C-shaped clamp 23 for pressing the inner wall surface of the first through hole 12 is pressed, so that the C-shaped clamp 23 is shrunk from the inner wall surface of the first through hole 12, as shown in FIG. 6. The failed connector 2 is loosened due to the pressing action of the C-shaped clamp 23, and finally released from the main base 1 by the push of the jig 100, as shown in FIG. 7. The failed connector 2 is detached, thereby replacing another connector 2 that is functional.

Figure 8:
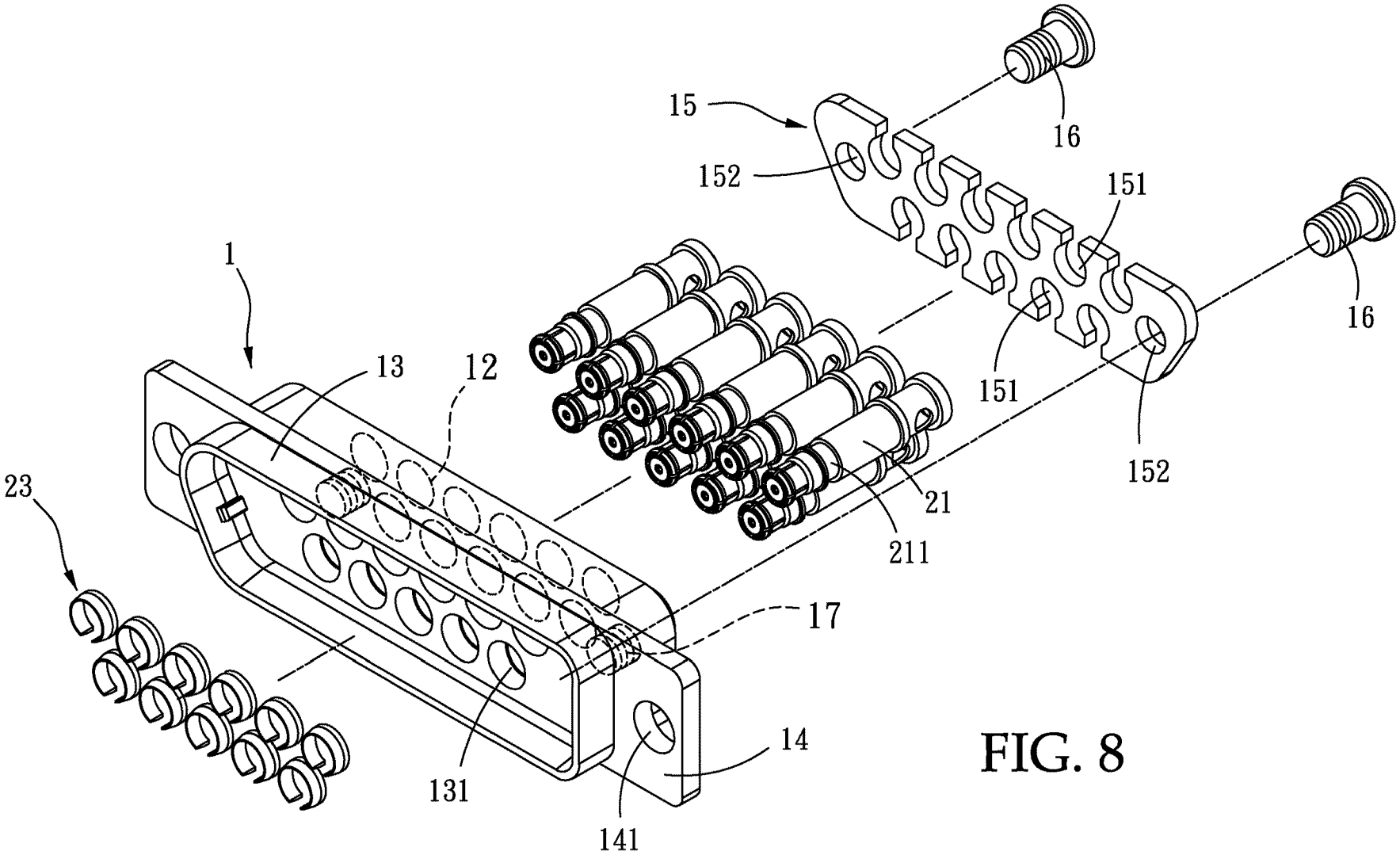
FIG. 8 is a perspective view of another embodiment of a connecting device of the present invention.

Referring to FIG. 8, which is a schematic perspective view of another embodiment of the present invention. In the embodiment, the connector 2 can also be a male connector, and the structure of the C-shaped clamp 23 is as described above.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A connecting device with multiple axial connectors, comprising:

a main base comprising a plurality of first through holes;

a plurality of connectors extending through the first through holes, wherein each of the connectors has a tubular body, each of the tubular bodies has a groove, a wire extends from one end of each connector, and a c-shaped clamp joins the groove and presses an inner surface of the first through hole, whereby the connectors is secured to the main base; and a protruding plate disposed on an end surface and corresponding to a plurality of second through holes, wherein the protruding plate comprises the plurality of second through holes, each second through hole corresponds to each first through hole so that the second through hole communicates with the corresponding first through hole;

wherein the main base further comprises two protruding seats disposed on the end surface and located on two sides of the protruding plate, each of the protruding seats has a concave hole.

2. The connecting device as claimed in claim 1, wherein the main base has a long shape.

3. The connecting device as claimed in claim 1, wherein the main base comprises two circular holes formed on another end surface opposite to the end surface on which the protruding plate is located.

4. A connecting device with multiple axial connectors, comprising:

a main base comprising a plurality of first through holes;

a plurality of connectors extending through the first through holes, wherein each of the connectors has a tubular body, each of the tubular bodies has a groove, a wire extends from one end of each connector, and a c-shaped clamp joins the groove and presses an inner surface of the first through hole, whereby the connectors is secured to the main base; and a fixing plate corresponding to an end surface of the main base and closing the end surface, wherein the fixing plate comprises a plurality of openings corresponding to the first through holes, a plurality of notches formed on the openings and corresponding to two lengthwise sides of the fixing plate and two latching holes formed near two end of the fixing plate respectively and allowing two latching members extending therethrough to fix a position of fixing plate relative to the main base.

5. The connecting device as claimed in claim 4, wherein the holes are c-shaped.

6. The connecting device as claimed in claim 4, wherein the latching members are fixing pins.

7. The connecting device as claimed in claim 4, wherein the latching members are T-shaped.

8. The connecting device as claimed in claim 1, wherein each of the connectors is one of male connectors or female connectors.

* * * * *